US007882650B2

(12) United States Patent
Elvin

(10) Patent No.: US 7,882,650 B2
(45) Date of Patent: Feb. 8, 2011

(54) LUGGAGE TAG

(75) Inventor: Kan Man Kit Elvin, New Territories (HK)

(73) Assignee: Collin Intertrade Co. Ltd, New Territories (HK)

( * ) Notice: Subject to any disclaimer, the term of this patent is extended or adjusted under 35 U.S.C. 154(b) by 277 days.

(21) Appl. No.: 12/233,600

(22) Filed: Sep. 19, 2008

(65) Prior Publication Data

US 2009/0100731 A1 Apr. 23, 2009

(30) Foreign Application Priority Data

Oct. 18, 2007 (HK) ..... 07111338.1

(51) Int. Cl.
*G09F 3/20* (2006.01)

(52) U.S. Cl. ..... 40/6; 40/642.02

(58) Field of Classification Search ..... 40/1.5, 40/6, 642.02, 649, 661, 611.03, 611.04; 206/39, 206/39.5, 232
See application file for complete search history.

(56) References Cited

U.S. PATENT DOCUMENTS 5,522,163 A * 6/1996 Neugebauer ..... 40/780
6,366,456 B1 * 4/2002 Wu et al. ..... 361/679.32
2004/0261305 A1 * 12/2004 Anderson ..... 40/661
2009/0084012 A1 * 4/2009 Kung ..... 40/642.02

* cited by examiner

*Primary Examiner*—Joanne Silbermann

(57) ABSTRACT

A luggage tag having a card case, a connecting part, and at least one cover is described. A first end of the cover is disposed with an engaging element, the engaging element is slightly larger than the body of the cover, two sides of the body of the cover each forms a locking corner at a position to which the engaging element is connected. The engaging element includes a groove or pressed line where the body can be lifted, which connects with the two sides thereof, and the cover is divided along the groove or pressed line into two parts, namely the engaging element and the body. The card case has at least one open face; a first end thereof corresponding to the engaging element includes an engaging cavity in a limiting unit. The engaging cavity corresponding to the locking corners is disposed with a lock, and the second end of the open face is disposed with a locking groove. When assembled, the cover will cover the open face thereby avoiding direct exposure of the information on the card.

29 Claims, 9 Drawing Sheets

LUGGAGE TAG

BACKGROUND OF THE INVENTION

The present invention relates to a luggage identification tag and more particularly pertains to a tag adapted for use in luggage shipments.

A luggage tag can help users accurately identify their own luggage, and when a user encounters a luggage loss, a luggage tag can help others to contact the user so that the luggage can be returned to the owner. Therefore, almost all people will attach a luggage tag to their luggage, particularly luggage for shipments, and state their name, address and even their contact phone number on the luggage tag to facilitate contact when a luggage is lost.

In general, airlines and freight companies provide free tags for users to write their contact information thereon, and then attach tags to luggage. To facilitate writing, these tags are mostly made of paper. As to reduce cost, tags are of rough construction. Most of the tags have a predisposed small aperture thereon for a rubber string, a metal string, or a cotton string and so on to pass through, so that users could use a rubber string and so on to attach the tag to a luggage. Tags of this rough construction are ripped off very easily. As such, many are lost in transportation processes. Even for those tags which have not been ripped off, they are mostly damaged, soiled, or on which writings become blurred and illegible due to water vapor, causing them to lose their identification function. Furthermore, contact information on these tags is completely exposed and very easily accessed by other people for promotion use, or even stolen by unlawful persons. Therefore, the privacy of users actually lacks protection.

Some airlines provide a tag strip in a long-strip shape with a locking slit disposed towards one end and a locking tongue disposed at the other end. Users write contact information on the body of the tag strip, then loop the tag strip to a luggage, and have the locking tongue passed through and locked up at the locking slit. This tag strip is usually made of a thin plastic on which people can write. However, a water-base or oil-base pen is required for writing, therefore it is not so convenient, and writings also easily become blurred and illegible due to water vapor. This tag strip is formed as an integrated body so it is more rigid than the aforementioned tags but there is still a chance for the tag to get detached. Furthermore, the strip for writing contact information is narrower, so it is more difficult for writing and also the contact information is completely exposed.

The prior art also teaches a luggage tag made of soft plastic, which is publicly known and publicly used. It comprises a transparent soft plastic case and a plastic locking strap. One side of the soft plastic case is an opening. Users can insert a paper card filled out with contact information into the soft plastic case, then pass the plastic locking strap through a predisposed aperture on one side of the soft plastic case. One end of the plastic locking strap has a locking element and the other end has a plurality of locking apertures. The locking element has a small hook which can be engaged with any of the locking apertures. Users can attach the soft plastic case to a luggage by means of engaging the locking element at one end with the locking aperture at the other end of the plastic locking strap. Users can directly engage a business name card into the soft plastic case and save the writing troubles, and can also change cards where necessary, so it is more convenient and durable than the aforesaid tags and tag strips. The prior art also teaches some improved soft plastic cases which are disposed with a foldable cover for covering contact information and thereby avoiding direct exposure of contact information.

However, a press button is required for the engagement and disengagement of the foldable cover, thereby increasing the manufacturing cost. As to reduce cost, a non-transparent material is being used for the soft plastic case. The plastic locking strap is thus required to be released for taking out a card or a paper card when viewing contact information, and so it is not very convenient for use. Besides, depending on the soft plastic material being used, this luggage tag made of soft plastic is still easily damaged and detached.

The prior art also provides a luggage tag made of leather which is commonly used by the general public. It mainly comprises a leather case and a leather locking strap, the construction of which is basically the same as the luggage tag made of soft plastic. As a leather material is non-transparent, one face of the body of the leather case is disposed with a transparent plastic sheet. Users can insert a paper card filled out with contact information or directly insert a business name card into the leather case, so contact information can be seen on the face of the transparent plastic sheet. As they are made with non-transparent leather, some luggage tags made of leather have a leather-made cover disposed on the face of the transparent sheet. One side of the cover is securely connected with the leather case, the other three sides are not connected with the leather case and the cover sufficiently covers the surface of the transparent plastic sheet so that contact information is not directly exposed. When users are required to view contact information, they can lift up the cover to see the contact information. This luggage tag made of leather is not that easily damaged, detached in comparison with the aforementioned luggage tags, contact information is not completely exposed too. However, leather increases the raw material cost and more manufacturing processes are required in luggage tags made of leather, thereby increasing the manufacturing cost. Furthermore, leather is not water resistant and gets moldy easily, thereby affecting the external appearance. Luggage tags made of leather are practically more difficult for cleaning and maintenance. Furthermore, the leather-made cover will warp and even roll up after being in use for a long time, resulting in contact information being directly exposed.

The prior art further provides other luggage tags made of hard plastic or metal. Their construction is basically the same as that of the luggage tags made of soft plastic or leather, but one face of the body is a transparent plastic sheet so that contact information can conveniently be viewed from the face of the transparent plastic sheet. However, in general, contact information is still completely exposed. For those with a movable covering device, it is not that convenient for use or the manufacturing cost is too high.

Therefore, users are still anticipating a luggage tag which is convenient for use, for changing cards, for cleaning and maintenance, is low in manufacturing cost, and contact information is not directly exposed, thereby avoiding information being easily accessed by other people for promotion use, or stolen by unlawful people, which may cause nuisance to users.

BRIEF SUMMARY OF THE INVENTION

In view of the aforesaid disadvantages now present in the prior art, the main object of the present invention is to provide a luggage tag, which can avoid the direct exposure of contact information. The other object of the present invention is to reduce the manufacturing processes of that luggage tag and hence the manufacturing cost. A further object of the present invention is to make that luggage tag convenient for use, for changing cards, and for cleaning and maintenance.

To attain this, the present invention adopts the following technical proposal:

A luggage tag which comprises a card case and a connecting part, a first end of the card case is disposed with an aperture, the aperture is for the connecting part to pass through as to attach the card case to a luggage, the card case has at least one open face, the card case is hollow inside as to hold at least one card, information on the card can be seen from the open face, wherein it further comprises at least one cover having a body and an engaging means; a first end of the cover is disposed with the engaging means, the engaging means is slightly larger than the body of the cover, two sides of the body of the cover each forms a locking corner at a position to which the engaging means is connected, the engaging means is disposed with a groove or a pressed line which connects with two sides thereof, the cover is divided along the groove or the pressed line into two parts, namely, the engaging means and the body, the groove or the pressed line forms a thinner folding area on the cover so that the body can be movably lifted up along the groove or the pressed line; a first end of the open face corresponding to the engaging means is disposed with an engaging cavity, the engaging means can be engaged into the engaging cavity so as to movably engage the cover with the open face, the engaging cavity corresponding to the engaging means is disposed with a limiting unit, the limiting unit horizontally secures the first end of the engaging means, the engaging cavity corresponding to the locking corners is disposed with a pair of locking means, the locking corners can be movably pushed into the locking means, a second end of the open face corresponding to a second end of the cover is disposed with a locking groove, the second end of the cover can be movably pushed into the locking groove; when the second end of the cover is pushed into the locking groove, the locking corners are pushed into the locking means, the body of the cover covers the open face and thereby avoiding direct exposure of the information on the card, and when the second end of the cover is pushed out of the locking groove, the locking corners are pushed out of the locking means, the body of the cover is lifted up along the groove or the pressed line and so the information on the card can be seen from the open face.

The card case and the cover can be made of the same material, the card case and the cover can be made of non-transparent polypropylene (PP), and can also be made of other plastic materials, such as, high-density polyethylene (HDPE), low-density polyethylene (LDPE), medium-density polyethylene (MDPE), polystyrene (PS), polymethyl methacrylate (PMMA), polyvinyl chloride (PVC), nylon, polycarbonate (PC), polyurethane (PU), polyetrafluoroethylene (PTFE), polyethylene terephthalate (PET) and so on.

The card case or the cover can respectively be made of different materials. To ensure no direct exposure of the information of a contact person, the cover is made of a non-transparent material, so when the cover is made of non-transparent polypropylene (PP), the card case is made of non-transparent light metal, or a non-transparent, a semi-transparent, or a transparent plastic material, such as acrylonitrile-butadiene-styrene, a copolymer (ABS), polymethyl methacrylate (PMMA), or polystyrene (general purpose) (GPPS) and so on.

To attain the rigidity of the cover which covers the open face and the durability of the card case and the cover, the Shore hardness of the plastic material for manufacturing the card case and the cover should be 93~100, the ideal Shore hardness is about 97.

The external appearance of the card case can be a rectangular shape matching with the shape of the card, and can also be any other shapes such as cartoon characters and so on as to enhance aesthetic quality. The card case can be predisposed with a card-shaped paper card inside for users to fill out their contact information.

The groove can be disposed on an underside face of the engaging means while the pressed line can be disposed on an upperside face of the engaging means. The groove or the pressed line is disposed on the underside face or the upperside face of the engaging means, appearing as a straight line, and is in parallel to the pair of the locking corners. The position of the groove or the pressed line can be close to the locking corners.

Two sides of the first end of the engaging means can each be disposed with an insertion connecting parts, the engaging cavity corresponding to the insertion connecting parts is disposed with a pair of insertion connecting part receiving means, the insertion connecting parts can be movably inserted into the insertion connecting part receiving means so as to increase the stability of the engaging means in the engaging cavity. The first end of the engaging means can be disposed with a plurality of insertion connecting parts, the engaging cavity corresponding to insertion connecting means is disposed with a plurality of insertion connecting part receiving means so as to increase the stability of the engaging means in the engaging cavity.

An underside face of the cover can be disposed with one or more protruding prints, when the cover covers the open face, the protruding prints can press against the card in the card case so as to secure the card in position. The protruding prints can form graphics so as to enhance aesthetic quality.

An upperside face of the second end of the cover can be disposed with one or more protruding pieces or recesses so as to facilitate the second end of the cover to be pushed into and out of the locking groove by hand.

The upperside face of the second end of the cover can be disposed with one or more protruding pieces, the underside face of the locking groove corresponding to the protruding pieces is disposed with mating recesses so as to increase the stability of the second end of the cover in the locking groove. The disposition can also be reversed, that is, the upperside face of the second end of the cover can be disposed with one or more recesses, and the underside face of the locking groove corresponding to the recesses is disposed with mating protruding pieces.

The open face corresponding to the two sides of the body of the cover can be disposed with a pair of sliding rails, the underside face of the two sides of the body of the cover is correspondingly disposed with a pair of sliding edges so as to increase the slidability of the cover when being pushed in or pushed out.

The thickness of the hollow of the card case can hold one to several overlapping cards.

The card case is disposed with one or more limiting units for securing the card in the card case. The limiting unit can be a rectangular card-shaped frame with three protruding sides and one non-protruding side, the non-protruding side is disposed on the side with the aperture for inserting the card into the card case.

The card case can be formed as an integrated body, or can also be formed by assembling two parts. The card case formed by assembling the two parts can be divided into a body on the rear side and an open face on the front side, and each of which is disposed with a corresponding aperture, two sides of the open face can be disposed with a pair of sliding grooves, two sides of the body are correspondingly disposed with a pair of sliding means, the body is slidably engaged with the open face. The first ends of the two sides of the open face close to the aperture can be disposed with a pair of slide stops, the two sides of the body are correspondingly disposed with a pair of slide stops as to limit the extent of sliding. The underside face of the ends of the two sides of the open face close to the aperture is disposed with one or more protruding pieces or recesses, the upperside face of the body corresponding to the protruding pieces or recesses is disposed with mating recesses or protruding pieces so as to increase the stability of the connection of the body and the open face. The card case formed by assembling the two parts can facilitate the connection of the cover and the open face.

The connecting part can be any connecting parts in the prior art, such as a plastic locking strap and so on.

When the body is made of a transparent or a semi-transparent plastic material such as acrylonitrile-butadiene-styrene, a copolymer (ABS), polymethyl methacrylate (PMMA), or polystyrene (general purpose) (GPPS), and so on, and its viewable area is approximately greater than 2.5 inches×3.5 inches, that is 6.3 cm×8.9 cm, users can put a 2R photo in the rear part of the card case and can see the photo from outside, therefore, the card case can simultaneously be used as a photo frame, serving two purposes at the same time.

The construction of the card case can also be changed to comprise two open faces, a front and a rear each, users can respectively put in different cards, for example, a commercial card is put on one face, a card with a written home address and a mobile phone number is put on the other face; or for example, contact information of one place is put on one face, contact information of another place is put on the other face, for the convenience of users who often travels between two places; or also when a couple travels together, a husband's card is put on one face, a wife's card is put on the other face.

The present invention operates as follows:

The card case, the cover and the connecting part are separate parts and manufactured in bulk. In assembly, if the card case is formed as an integrated body, the engaging means is engaged into the engaging cavity, the end of the engaging means is horizontally secured by the limiting unit, the second end of the cover is pushed into the locking groove, the locking corners are pushed into the locking means, the cover is thereby movably connected with the open face, If the card case is formed by assembling two parts, the body is first slidably engaged with the open face, then the cover and the open face are movably connected. Finally, the assembly is complete by passing the connecting part through the aperture. In general, the luggage tag leaves a factory after the assembly is complete.

In use, a user can first withdraw the connecting part from the aperture, insert a card into the card case, or take out a card-shaped paper card in the card case, and fill out contact information, insert the card-shaped paper card into the card case again, then pass the connecting part through the aperture and attach the card case to a luggage again. The cover covers the open face, thereby avoiding direct exposure of the information on the card.

To view the information, the second end of the cover is pushed out of the locking groove, the locking corners are thereby pushed out of the locking means, as the second end of the cover is no longer being pressed, and the groove or the pressed line causes the second end of the cover to slightly spring up accordingly, a user can therefore lift up the cover easily and see the contact information through the open face. After use, the second end of the cover is pushed into the locking groove, the locking corners are thereby pushed into the locking means, the cover covers the open face and thereby avoiding direct exposure of the information on the card.

If the card case is simultaneously be used as a photo frame, a user can simultaneously put a 2R photo into the rear part of the card case. If the card case comprises two open faces, the front and the rear, a user can respectively put in different cards, or put a card on one face, put a card-shaped paper card filled with contact information on the other face.

In comparison with the prior art, the advantages and effects of the present invention are:

Firstly, as the cover of the present invention is made of a non-transparent plastic material, and the cover can securely cover the open face, the cover is only lifted open when necessary for viewing the information, so it more effectively avoids direct exposure of the contact information.

Secondly, as the present invention only has the card case, the cover and the connecting part, the construction is simple. The card case can be formed as an integrated body, or formed by assembling two parts, the card case and the cover can be formed by using the same material, so the manufacturing processes are lesser than those of the prior art, the manufacturing cost is susceptibly lower.

Thirdly, the cover of the present invention is of simple construction, the cover can be conveniently and quickly opened or closed by slightly pushing the cover. A user can also directly put a card into the card case, change cards as necessary. The card case and the cover are made of a plastic material or the card case is made of a light metal material to facilitate cleaning and maintenance.

DETAILED DESCRIPTION OF THE INVENTION

The preferred embodiments of the present invention not limited thereto are further described in detail with the following embodiments and the accompanying drawings.

Figure 1:
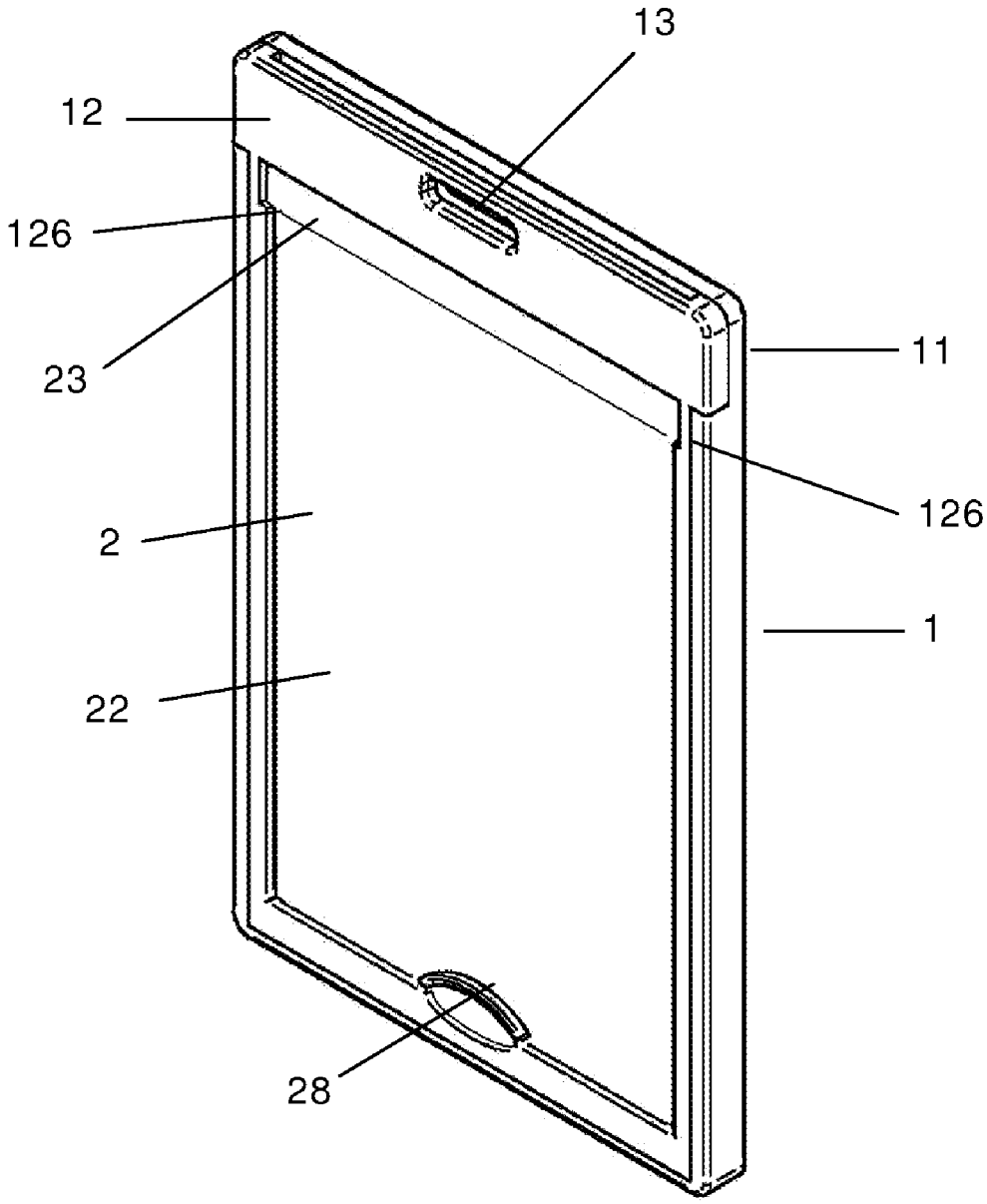
FIG. 1 is a perspective view of the first embodiment of the present invention.
Figure 2:
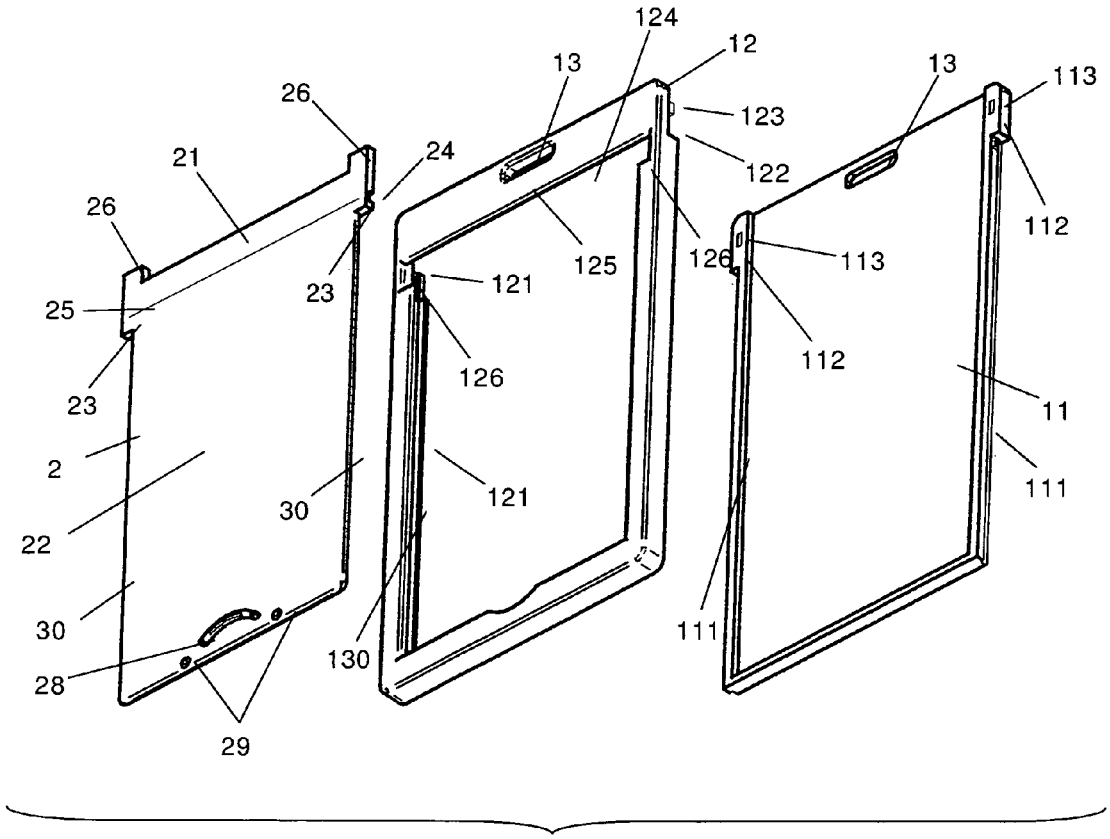
FIG. 2 is a front exploded view of the card case and the cover of FIG. 1.
Figure 3:
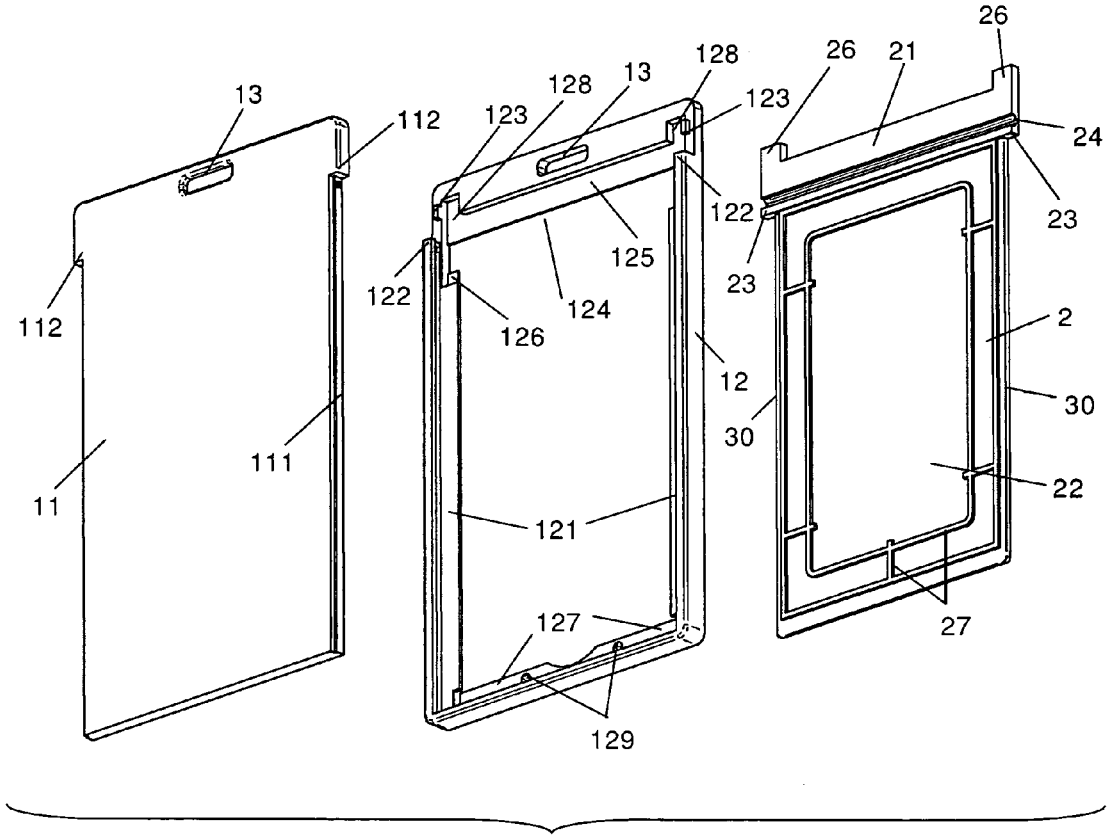
FIG. 3 is a rear exploded view of the card case and the cover of FIG. 1.
Figure 4:
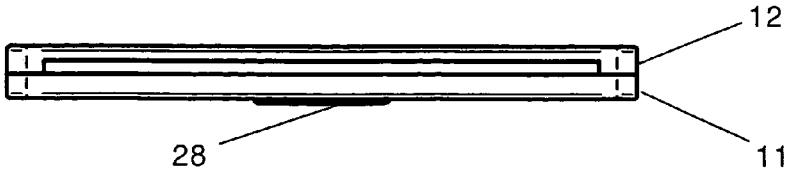
FIG. 4 is a top view of the card case of FIG. 1.
Figure 5:
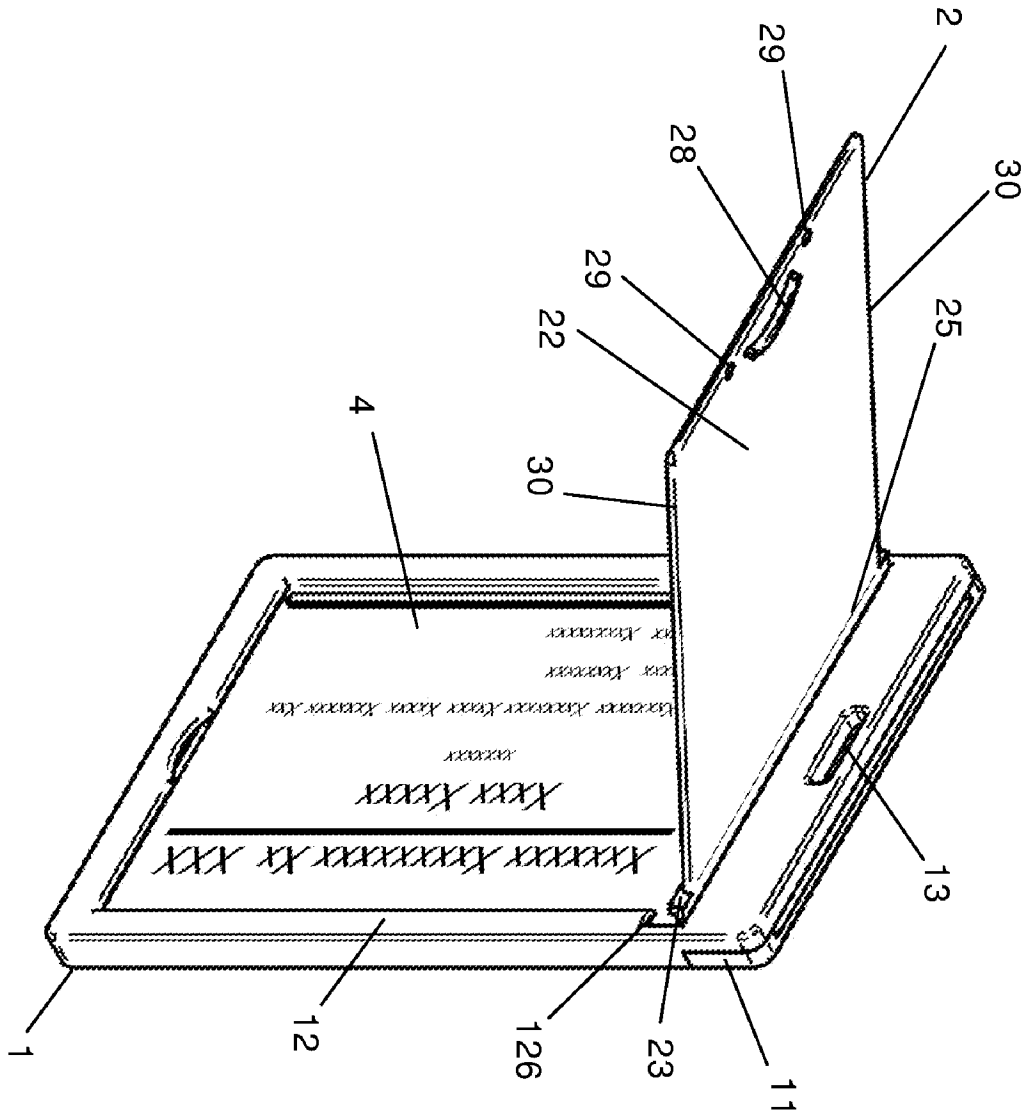
FIG. 5 is a perspective view of FIG. 1 after the cover is open.
Figure 6:
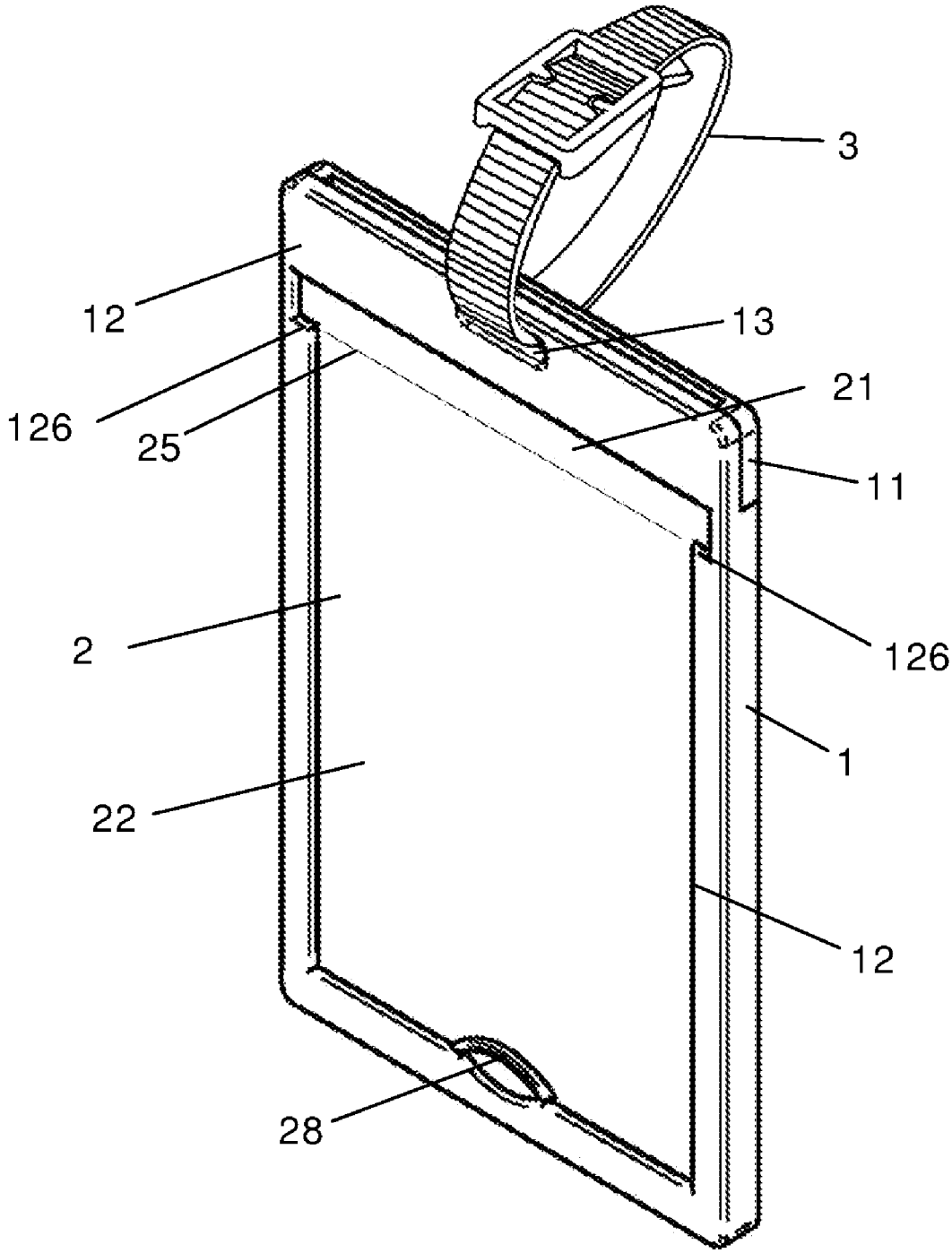
FIG. 6 is a perspective view of the first embodiment attached with the connecting part.

FIG. 1 to FIG. 6 illustrate the construction and the operations of the first embodiment of the present invention. As illustrated in FIG. 1 and FIG. 6, the present embodiment is a luggage tag which comprises a card case 1, a cover 2 and a connecting part 3. The card case 1 and the cover 2 are made of same material. The card case 1 and the cover 2 are made of non-transparent polypropylene (PP) with a Shore hardness of about 97. In other embodiments, the card case 1 and the cover 2 may be made of other non-transparent plastic material, may also be a non-transparent cover 2 matched by the card case 1 made of non-transparent light metal, or a non-transparent, a semi-transparent or a transparent plastic material, that is, the card case 1 and the cover 2 are made of different materials. As illustrated in FIG. 4, the card case 1 is hollow inside, its thickness can hold one or more overlapping cards 4, the card case 1 is predisposed with a card-shaped paper card 4 inside for a user to write the contact information. The connecting part 3 in the present embodiment is a plastic strap. In other embodiments, it may be any connecting parts in the prior art. In the present embodiment, the card case 1 is formed by assembling two parts. In other embodiments, the card case may be an integrated body. As illustrated in FIG. 2 and FIG. 3, the two parts are a body 11 on the rear side and an open face 12 on the front side, and each is disposed with a corresponding aperture 13. The aperture 13 is for the connecting part 3 to pass through as to attach the card case 1 to a luggage. Two sides of the open face 12 are disposed with a pair of sliding grooves 121, the two sides of the body 11 are correspondingly disposed with a pair of sliding means 111, the body 11 is slidably engaged with the open face 12. The first ends of the two sides of the open face 12 close to the aperture 13 are disposed with a pair of slide stops 122, the two sides of the body 11 are correspondingly disposed with a pair of slide stops 112 so as to limit extent of sliding. An underside face of the first ends of the two sides of the open face 12 close to the aperture 13 is further disposed with one or more protruding pieces 123, an upperside face of the body 11 corresponding to the protruding pieces 123 is disposed with mating recesses 113, as to increase the stability of the connection of the body 11 and the open face 12. The card case 1 formed by assembling the two parts can facilitate the connection of the cover 2 and the open face 12. In other embodiments, the open face 12 may not be disposed with slide stops 122, the body 11 may also not be disposed with slide stops 112. In other embodiments, the open face 12 may also not be disposed with the protruding pieces 123, and the body 11 is not disposed with the recesses 113, or the open face 12 is disposed with the recesses, and the body 11 is disposed with the protruding pieces. The card case 1 is hollow inside as to hold at least one card 4, the information on the card 4 can be seen from the open face 12. In the present embodiment, the external appearance of the card case 1 is of a rectangular shape matching with the shape of the card 4. In other embodiments, it may be of any other shapes, such as cartoon characters and so on, as to enhance the aesthetic quality. The card case 1 is disposed with a limiting unit as to secure the card 4 in position in the card case 1, in the present embodiment, the sliding means 111 are part of the construction of the limiting unit, the limiting unit is a frame in the shape of the card 4, with three protruding sides and one non-protruding side, the non-protruding side is disposed on the side with the aperture 13 for inserting the card 4 into the card case 1, as illustrated in FIG. 4.

As illustrated in FIG. 2 and FIG. 3, the first end of the cover 2 is disposed with an engaging means 21, the engaging means 21 is slightly larger that the body 22 of the cover 2, two sides of the body 22 of the cover 2 each forms a locking corner 23 at a position to which the engaging means 21 is connected, the engaging means 21 is disposed with a groove 24 and a pressed line 25 which connect with the two sides thereof, the cover 2 is divided along the groove 24 or the pressed line 25 into two parts, namely, the engaging means 21 and the body 22, the groove 24 and the pressed line 25 form a thinner folding area on the cover 2, a groove 24 is disposed on an underside face of the engaging means 21 while the pressed line is disposed on an upperside face of the engaging means 21. The groove 24 and the pressed line 25 appear as straight lines and are in parallel to a pair of locking corners 23, the body 22 can be movably lifted up along the groove 24 and the pressed line 25. In other embodiments, only the groove 24 or the pressed line 25 but not both of them can be disposed. The first end of the open face 12 corresponding to the engaging means 21 is disposed with an engaging cavity 124, the engaging means 21 can be engaged into the engaging cavity 124 so as to movably connect the cover 2 with the open face 12, the engaging cavity 124 corresponding to the engaging means 21 is disposed with a limiting unit 125, the limiting unit 125 horizontally secures the first end of the engaging means 21, the engaging cavity 124 corresponding to the locking corners 23 is disposed with a pair of locking means 126, the locking corners 23 can be movably pushed into the locking means 126. Two sides of the first end of the engaging means 21 each is disposed with an insertion connecting part 26, the engaging cavity 124 corresponding to the insertion connecting parts 26 is disposed with a pair of insertion connection part receiving means 128, the insertion connecting parts 26 can be movably inserted into the insertion connecting part receiving means 128 so as to increase the stability of the engaging means 21 in the engaging cavity 124. In other embodiments, the first end of the engaging means 21 may be disposed with a plurality of insertion connecting parts 26, the engaging cavity 124 corresponding to the engaging means 26 is disposed with a plurality of insertion connecting part receiving means 128 so as to increase the stability. In other embodiments, the first end of the engaging means 21 may not be disposed with any insertion connecting part 26, and the engaging cavity 124 corresponding to the insertion connecting part 26 may also not be disposed with any insertion connecting part receiving means 128. The second end of the open face 12 corresponding to the second side of the cover 2 is disposed with a locking groove 127, the second end of the cover 2 can be movably pushed into the locking groove 127. The open face 12 corresponding to the two sides of the body 22 of the cover 2 is disposed with a pair of sliding rails 130, the underside face of the two sides of the body 22 of the cover 2 is correspondingly disposed with a pair of sliding edges 30 so as to increase the slidability of the cover 2 when being pushed in and pushed out. When the second end of the cover 2 is pushed into the locking groove 127, the locking corners 23 are pushed into the locking means 126, the body 22 of the cover 2 covers the open face 12 and thereby avoiding direct exposure of the information on the card 4, and when the second end of the cover 2 is pushed out of the locking groove 127, the locking corners 23 are pushed out of the locking means 126, the body 22 of the cover 2 can be lifted up along the groove 24 or the pressed line 25, the information on the card 4 can be seen from the open face 12.

In the present embodiment, the underside face of the cover 2 can be disposed with one or more protruding prints 27, when the cover 2 covers the open face 12, the protruding print 27 can press against the card 4 in the card case 1 so as to secure the card 4 in position. The protruding prints form graphics to enhance the aesthetic quality. The upperside face of the second end of the cover 2 is disposed with a protruding piece 28 so as to facilitate the second end of the cover 2 being pushed into or out of the locking groove 127 by hand. In other embodiments, the upperside face of the second end of the cover 2 may be disposed with one or more protruding pieces 28 or recesses. The upperside face of the second end of the cover 2 may further be disposed with two indenting apertures 29, the underside face of the locking groove 127 corresponding to the indenting apertures 29 is disposed with two mating protruding means 129 so as to increase the stability of the second end of the cover 2 in the locking groove 127. In other embodiments, the disposition may also be reversed, may also be disposed with one or more such devices.

In use, a user can first withdraw the connecting part 3 from the aperture 13 and can insert the card 4 into the card case 1, or take out the card-shaped paper card 4 in the card case 1, and fill out the contact information, insert the card-shaped paper card 4 into the card case 1 again, then pass the connecting part 3 through the aperture 13 and attach the card case 1 to a luggage again. The cover 2 covers the open face 12 and thereby avoiding direct exposure of the information on the card 4, as illustrated in FIG. 1.

To view the information, the second end of the cover 2 is pushed out of the locking groove 127, the locking corners 23 are pushed out of the locking means 126, as the second end of the cover 2 is no longer being pressed, the groove 24 and the pressed line 25 therefore cause the second end of the cover 2 to slightly spring up accordingly, so a user can lift up the cover 2 easily and can see the contact information from the open face 12, as illustrated in FIG. 5. After use, the second end of the cover 2 is pushed into the locking groove 127, thereby the locking corners 23 are pushed into the locking means 126, the cover 2 covers the open face 12 and thereby avoiding direct exposure of the information on the card 4, as illustrated in FIG. 6.

Figure 7:
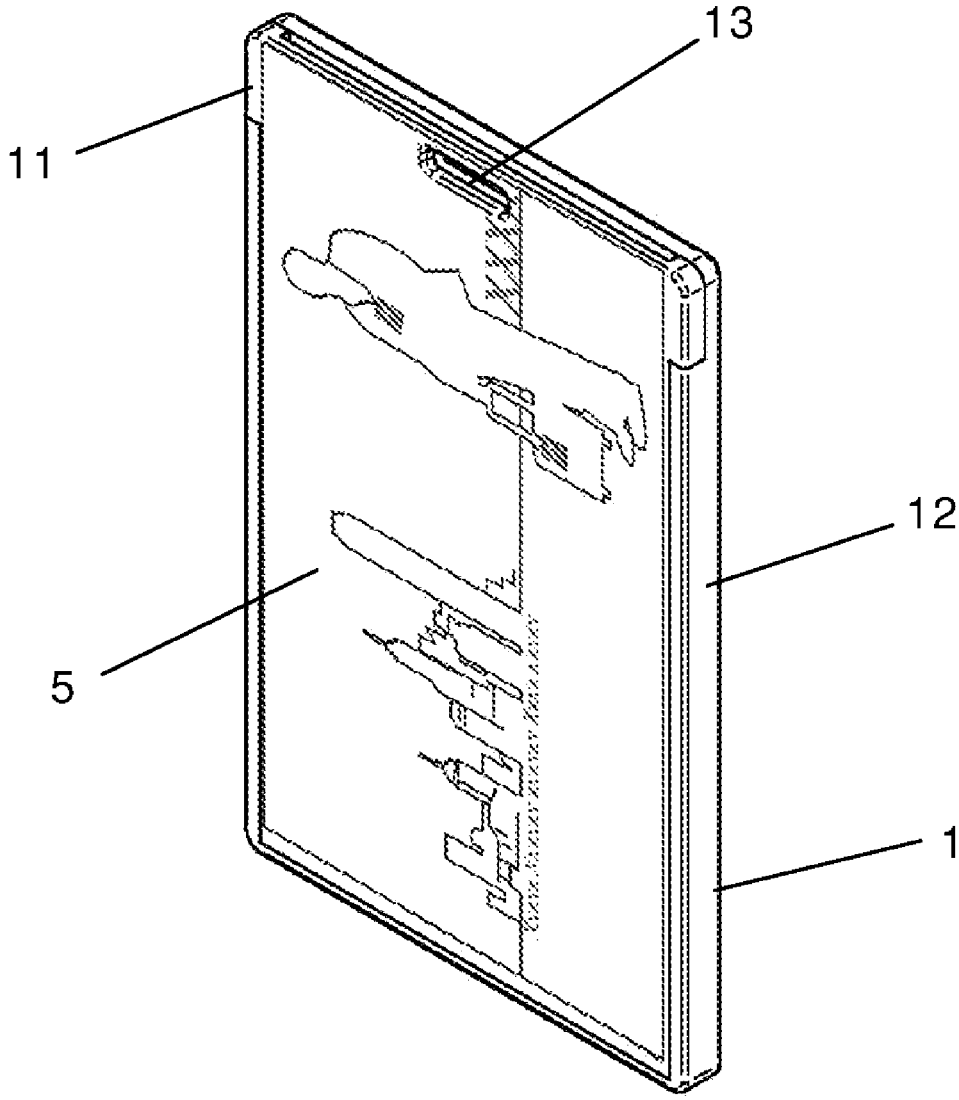
FIG. 7 is a back view of the second embodiment of the present invention.

FIG. 7 illustrates the second embodiment of the present invention, the construction and the operations of the second embodiment are basically the same as those of the first embodiment. In the second embodiment, the card case 1 is made of transparent acrylonitrile-butadiene-styrene, a copolymer (ABS), its Shore hardness is about 100, the cover 2 is made of non-transparent polypropylene (PP), its Shore hardness is about 93, and the viewable area on the rear part of the card case 1 is greater than 2.5 inches×3.5 inches, that is, 6.3 cm×8.9 cm. A user can insert a card into the card case 1 on the face with the cover 2 and put in a 2R photo 5 in the rear part of the card case 1, a user can see the photo 5 from outside, the card case can therefore simultaneously be used as a photo frame, serving two purposes at the same time, as illustrated in FIG. 7. In other embodiments, the card case 1 may be made of polymethyl methacrylate (PMMA) or polystyrene (general purpose) (GPPS), the Shore hardness of the two plastic materials can respectively be in the region of 93~100, as to attain the rigidity of the cover 2 to cover the open face 12 and the durability of the card case 1 and the cover 2.

Figure 8:
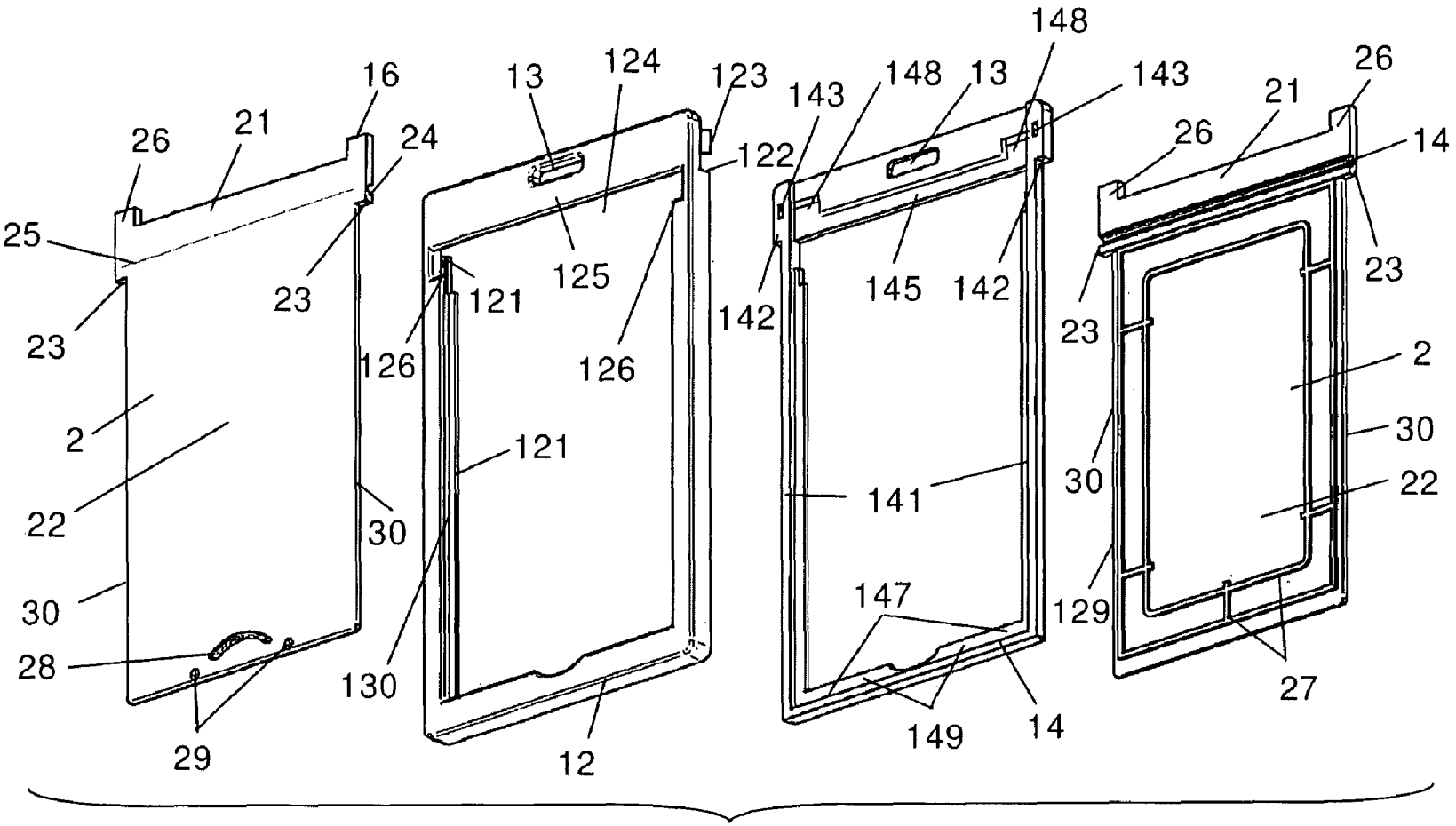
FIG. 8 is a front exploded view of the card cases and the covers of the third embodiment of the present invention.
Figure 9:
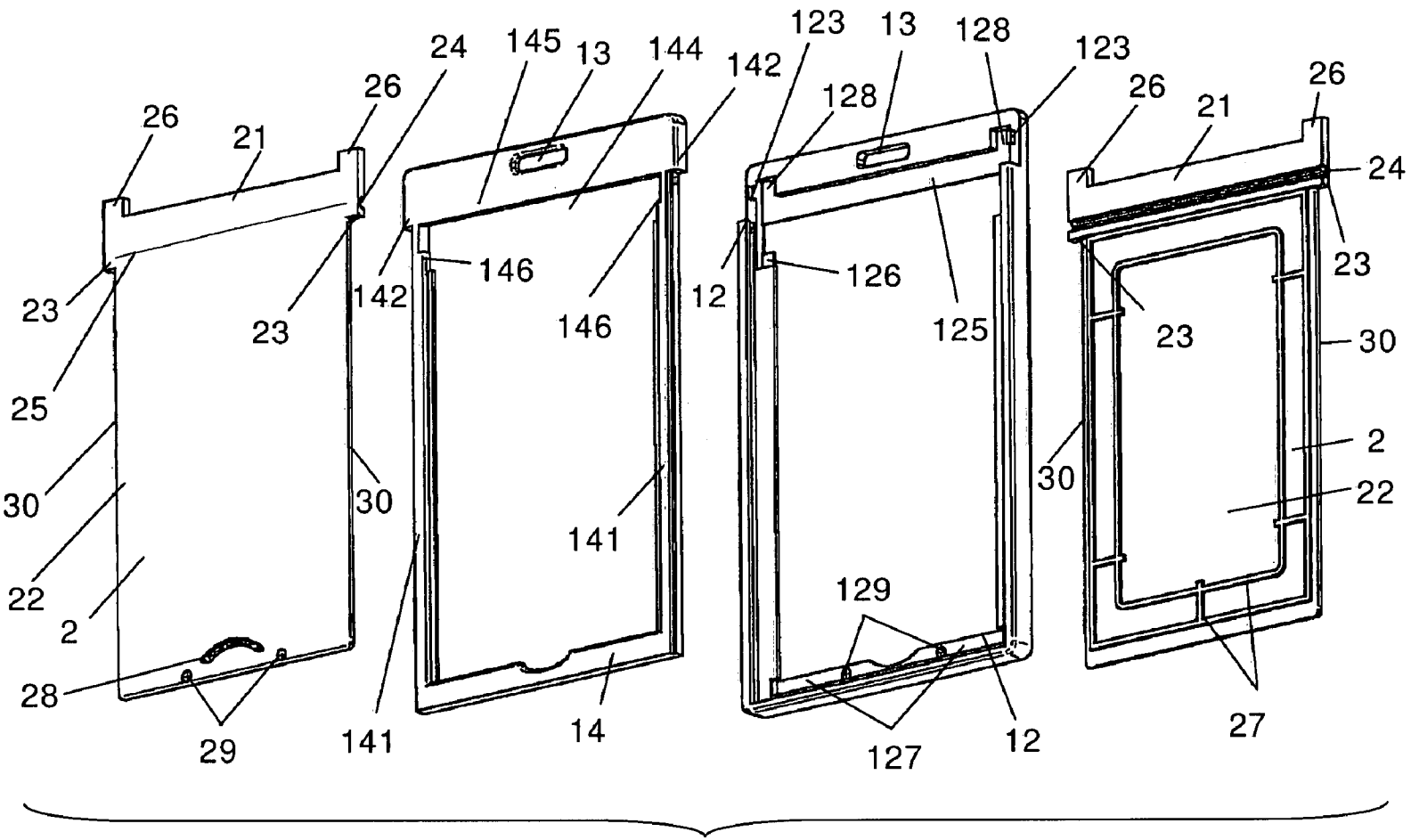
FIG. 9 is a rear exploded view of the card cases and the covers of FIG. 8.
Figure 10:
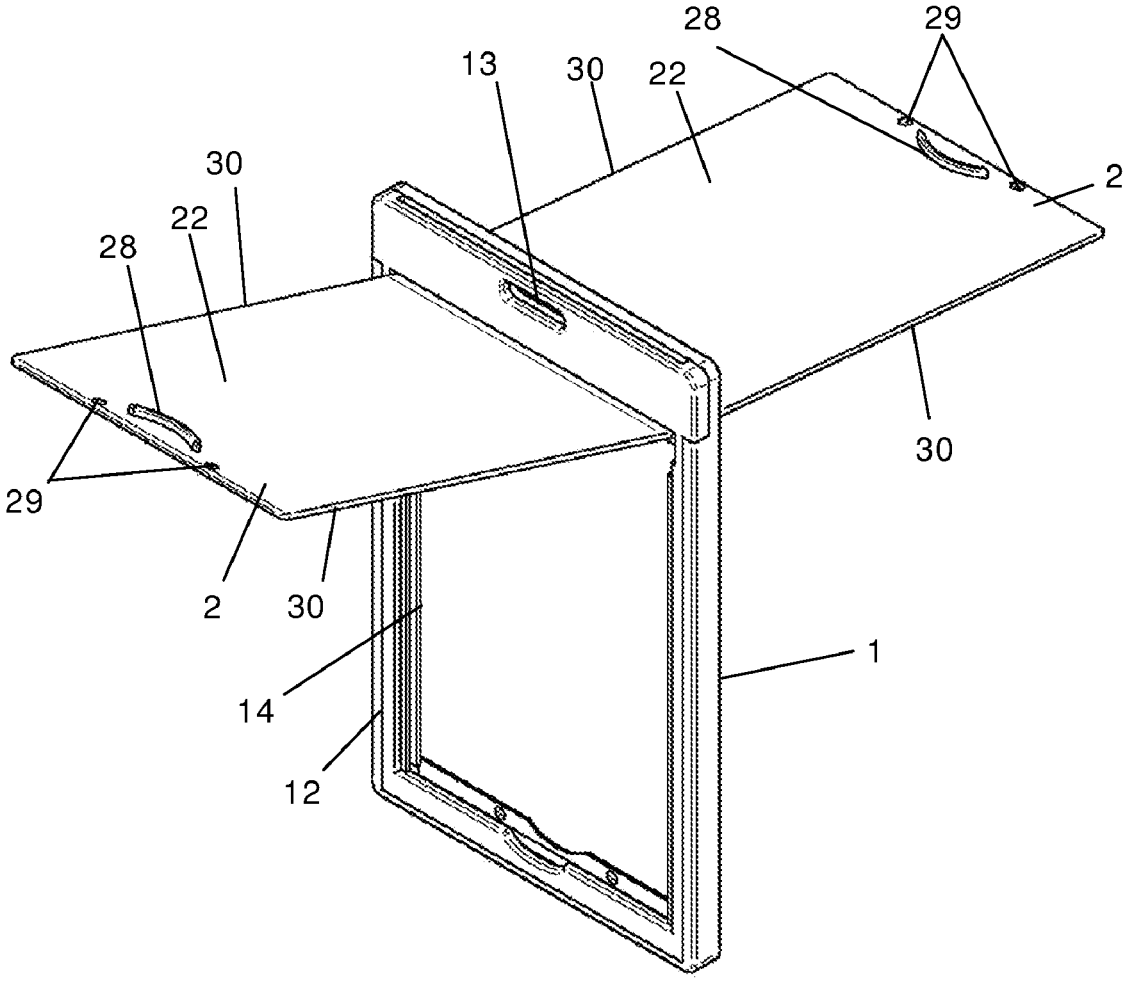
FIG. 10 is a perspective view of FIG. 8 after the covers are open.

FIG. 8 to FIG. 10 illustrate the third embodiment of the present invention, the construction and the operations of the third embodiment are basically the same as those of the first embodiment. The construction of the third embodiment comprises a card case 1 and two covers 2 disposed on the front side and the rear side respectively. In other embodiments, the two rear parts of the two card cases 1 as illustrated in the first embodiment may just be secured together, but this construction wastes materials and doubles the thickness of the card cases 1 and is not convenient for use, so the present embodiment adopts the construction of only one card case. The card case 1 and the covers 2 are both made of non-transparent polypropylene (PP), the Shore hardness is both about 97. In the present embodiment, the card case 1 is formed by assembling two open faces, 12, 14, the two open faces 12, 14 each is disposed with a corresponding aperture 13 for the connecting part 3 to pass through as to attach the card case 1 to a luggage, the two sides of the first open face 12 are disposed with a pair of sliding grooves 121, the two sides of second open face 14 are correspondingly disposed with a pair of sliding means 141, the second open face 14 is slidably engaged with the first open face 12. The ends of the two sides of the first open face 12 close to the aperture 13 are disposed with a pair of slide stops 122, the two sides of the second open face 14 are correspondingly disposed with a pair of slide stops 142 so as to limit the extent of sliding. The underside face of the first ends of the two sides of the first open face 12 close to the aperture is further disposed with one or more protruding pieces 123, the upperside face of the second open face 14 corresponding to the protruding pieces 123 is disposed with mating recesses 143 so as to increase the stability of the connection of the second open face 14 and the first open face 12. The card case 1 formed by assembling the two open faces 12, 14 can facilitate the connection of the covers 2 and the open faces 12, 14. In other embodiments, the first open face 12 may not be disposed with the slide stops 122, the second open face 14 may also not be disposed with the slide stops 142, and the first open face 12 may also not be disposed with protruding pieces 123, and the second open face 14 is not disposed with recesses 143, or the first open face 12 is disposed with recesses, and the second open face 14 is disposed with protruding pieces. In other embodiments, the two open faces 12, 14 can be formed as an integrated body. The hollow in the card case 1 can hold at least two cards 4 so as to facilitate a user to put in two different cards 4, the information on the cards 4 can be seen from the open faces 12, 14. In the present embodiment, the external appearance of the card case is a rectangular shape, matching the shape of the cards 4. In other embodiments, it may be of any shape, such as cartoon characters and so on, as to enhance the aesthetic quality. The card case 1 is disposed with a limiting unit as to secure the cards 4 in position in the card case 1. In the present embodiment, the sliding means 141 are part of the construction of the limiting unit.

As illustrated in FIG. 8 and FIG. 9, the construction of the two covers 2 is the same as the cover of the first embodiment. The first ends of the open faces 12, 14 corresponding to the engaging means 21 each is disposed with an engaging cavity 124, 144, the engaging means 21 can be engaged into the engaging cavities 124, 144, as to movably connect the covers 2 and the open faces 12, 14, the engaging cavities 124, 144 corresponding to the engaging means 21 each is disposed with a limiting unit 125, 145, the engaging cavities 124, 144 corresponding to the locking corners 23 each is disposed with a pair of locking means 126, 146. The engaging cavities 124, 144 corresponding to the insertion connecting parts 26 each is disposed with a pair of insertion connecting part receiving means 128, 148, the insertion connecting parts 26 can be movably inserted into the insertion connecting part receiving means 128, 148 so as to increase the stability of the engaging means 21 in the engaging cavities 124, 144. In other embodiments, the first end of the engaging means may be disposed with in plurality of insertion connecting parts 26, the engaging cavities 124, 144 corresponding to the insertion connecting parts 26 are disposed with a plurality of insertion connecting part receiving means 128, 148 so as to increase the stability. In other embodiments, the first end of the engaging means 21 may not be disposed with insertion connecting parts 26, and the engaging cavities 124, 144 corresponding to the insertion connecting parts 26 may also not be disposed with insertion connecting part receiving means 128, 148. The second ends of the open faces 12, 14 corresponding to the second ends of the covers 2 each is disposed with a locking groove 127, 147, the second ends of the covers 2 can be movably pushed into the locking grooves 127, 147. The opening faces 12, 14 corresponding to the two sides of the bodies 22 of the covers are disposed with a pair of sliding rails 130, the underside faces of the two sides of the bodies 22 of the covers 2 are correspondingly disposed with a pair of sliding edges 30 so as to increase the slidability of the covers 2 when being pushed in and pushed out. When the second ends of the covers 2 are pushed into the locking grooves 127, 147, the locking corners 23 are pushed into the locking means 126, 146, the bodies 22 of the covers 2 cover the open faces 12, 14 and thereby avoiding direct exposure of the information on the cards 4, and when the second ends of the covers 2 are pushed out of the locking grooves 127, 147, the locking corners 23 are pushed out of the locking means 126, 146, the bodies 22 of the covers 2 can be lifted up along the grooves 24 or the pressed lines 25, the information of the different cards 4 can be seen from the open faces 12, 14.

In the present embodiment, the uppersides face of the second ends of the covers 2 are disposed with protruding means 28, as to facilitate the second ends of the covers being pushed into or pushed out of the locking grooves 127, 147 by hand. In other embodiments, the upperside faces of the second ends of the covers 2 may be disposed with one or more protruding means 28 or indenting means. The upperside faces of the second ends of the covers 2 may further be disposed with two indenting apertures 29, the underside faces of the locking grooves 127, 147 corresponding to the indenting apertures 29 are disposed with two mating protruding means 129, 149 so as to increase the stability of the second ends of the covers 2 in the locking grooves 127, 147. In other embodiments, the disposition may also be reversed, may also be disposed with one or more such devices.

In use, the operations are the same as those of the first embodiment, a user can insert two different cards 4 or card-shaped paper cards 4 filled with contact information into the card case 1. To view the information, the second ends of the covers are pushed out of the locking groove 127 of the first open face 12 or/and the locking groove 147 of the second open face 14, the locking corners 23 are pushed out of the locking means 126 or/and the locking means 146, as the seconds ends of the covers 2 are not pressed, the grooves 24 and the pressed lines 25 therefore cause the second ends of the covers 2 to slightly spring up accordingly, so a user can lift up the covers 2 easily and can see the different contact information of the contact person from the first open face 12 or the second open face 14, as illustrated in FIG. 9. After use, the second ends of the cover 2 are pushed into the locking grooves 127 or/and 147, the locking corners are pushed into the locking means 126 or/and the locking means 146, the covers 2 cover the open faces 12, 14 and thereby avoiding direct exposure of the information on the cards 4.

The above embodiments are the preferred embodiments of the present invention. The present invention is capable of other embodiments and is not limited to the above embodiments. Any other variation, decoration, substitution, combination or simplification, whether in substance or in principle, not deviated from the spirit of the present invention, is replacement or substitution of equivalent effect and falls within the scope of protection of the present invention.

What is claimed is:

1. A luggage tag which comprises a card case and a connecting part, a first end of the card case is disposed with an aperture, the aperture is for the connecting part to pass through so as to attach the card case to a luggage, the card case has at least one open face, the card case is hollow inside as to hold at least one card, information on the card can be seen from the open face, wherein it further comprises at least one cover having a body and an engaging means; a first end of the cover is disposed with the engaging means, the engaging means is slightly larger than the body of the cover, two sides of the body of the cover each forms a locking corner at a position to which the engaging means is connected, the engaging means is disposed with a groove or a pressed line which connects with two sides thereof, the cover is divided along the groove or the pressed line into two parts, namely, the engaging means and the body, the groove or the pressed line forms a thinner folding area on the cover so that the body can be movably lifted up along the groove or the pressed line; a first end of the open face corresponding to the engaging means is disposed with an engaging cavity, the engaging means can be engaged into the engaging cavity so as to movably engage the cover with the open face, the engaging cavity corresponding to the engaging means is disposed with a limiting unit, the limiting unit horizontally secures the first end of the engaging means, the engaging cavity corresponding to the locking corners is disposed with a pair of locking means, the locking corners can be movably pushed into the locking means, a second end of the open face corresponding to a second end of the cover is disposed with a locking groove, the second end of the cover can be movably pushed into the locking groove.

2. A luggage tag as in claim 1, wherein the groove is disposed on an underside face of the engaging means while the pressed line is disposed on an upperside face of the engaging means.

3. A luggage tag as in claim 1, wherein the groove or the pressed line is disposed on an underside face or an upperside face of the engaging means, appearing as a straight line, and is in parallel to the pair of the locking corners.

4. A luggage tag as in claim 1, wherein the position of the groove or the pressed line can be close to the locking corners.

5. A luggage tag as in claim 1, wherein two sides of the first end of the engaging means each is disposed with an insertion connecting part, the engaging cavity corresponding to the insertion connecting part is disposed with a pair of insertion connecting part receiving means, the insertion connecting parts can be movably received in the insertion connecting part receiving means so as to increase the stability of the engaging means in the engaging cavity.

6. A luggage tag as in claim 1, wherein the first end of the engaging means is disposed with a plurality of insertion connecting parts, the engaging cavity corresponding to insertion connecting parts is disposed with a plurality of insertion connecting part receiving means so as to increase the stability of the engaging means in the engaging cavity.

7. A luggage tag as in claim 1, wherein an upperside face of the second end of the cover is disposed with one or more protruding pieces or recesses so as to facilitate the second end of the cover to be pushed into or pushed out of the locking groove by hand.

8. A luggage tag as in claim 1, wherein the open face corresponding to the two sides of the body of the cover is disposed with a pair of sliding rails, an underside face of the two sides of the body of the cover is correspondingly disposed with a pair of sliding edges so as to increase the slidability of the cover when being pushed in or pushed out.

9. A luggage tag as in claim 1, wherein the card case is disposed with one or more limiting units for securing the card in the card case.

10. A luggage tag as in claim 9, wherein the limiting unit is a rectangular card-shaped frame with three protruding sides and one non-protruding side, the non-protruding side is disposed on the side with the aperture for inserting the card into the card case.

11. A luggage tag as in claim 1, wherein the card case is formed as an integrated body.

12. A luggage tag as in claim 1, wherein the card case is formed by assembling two parts.

13. A luggage tag as in claim 12, wherein the card case is divided into a body on a rear side and an open face on the front side, and each of which is disposed with a corresponding aperture, two sides of the open face can be disposed with a pair of sliding grooves, two sides of the body are correspondingly disposed with a pair of sliding means, the body is slidably engaged with the open face.

14. A luggage tag as in claim 13, wherein first ends of the two sides of the open face close to the aperture are disposed with a pair of slide stops, the two sides of the body are correspondingly disposed with a pair of slide stops so as to limit extent of sliding.

15. A luggage tag as in claim 13 or claim 14, wherein an underside face of the first ends of the two sides of the open face close to the aperture is disposed with one or more protruding pieces or recesses, an upperside face of the body corresponding to the protruding pieces or recesses is disposed with mating recesses or protruding pieces so as to increase the stability of the connection of the body and the open face.

16. A luggage tag as in claim 1, wherein the external appearance of the card case is a rectangular shape.

17. A luggage tag as in claim 1, wherein the external appearance of the card case is a cartoon character.

18. A luggage tag as in claim 1, wherein an underside face of the cover can be disposed with one or more protruding prints, when the cover covers the open face, the protruding prints press against the card in the card case so as to secure the card in position.

19. A luggage tag as in claim 18, wherein the protruding prints can form graphics so as to enhance aesthetic quality.

20. A luggage tag as in claim 1, wherein an upperside face of the second end of the cover is further disposed with one or more protruding means, an underside face of the locking groove corresponding to the protruding means is disposed with mating indenting apertures so as to increase the stability of the second end of the cover in the locking groove.

21. A luggage tag as in claim 1, wherein an upperside face of the second end of the cover is further disposed with one or more indenting apertures, an underside face of the locking groove corresponding to the indenting apertures is disposed with mating protruding means so as to increase the stability of the second end of the cover in the locking groove.

22. A luggage tag as in claim 1, wherein thickness of the hollow of the card case can hold one to several overlapping cards.

23. A luggage tag as in claim 22, wherein the card case and the cover are both made of polypropylene (PP).

24. A luggage tag as in claim 1, wherein the card case and the cover are both made of a plastic material.

25. A luggage tag as in claim 1, wherein the card case and the cover are made of different materials, the card case is made of non-transparent light metal, or a non-transparent, a semi-transparent, or a transparent plastic material, and the cover is made of a non-transparent plastic material.

26. A luggage tag as in claim 25, wherein the card case is made of a transparent or semi-transparent plastic material, a 2R photo can be put in a rear part of the card case, and the card case is used as a photo frame.

27. A luggage tag as in claim 26, wherein the card case is made of transparent or semi-transparent acrylonitrile-butadiene-styrene, a copolymer (ABS), polymethyl methacrylate (PMMA), or polystyrene (general purpose) (GPPS).

28. A luggage tag as in claim 25, wherein the cover is made of non-transparent polypropylene (PP).

29. A luggage tag as in claim 1, wherein the card case is predisposed with a card-shaped paper card inside for a user to fill out contact information.

* * * * *